US007686025B1

(12) United States Patent
Dowling

(10) Patent No.: US 7,686,025 B1
(45) Date of Patent: Mar. 30, 2010

(54) BEACH CANE FLIP-FLOP SYSTEM

(76) Inventor: Anthony R. Dowling, 6100 9th Ave. North, St. Petersburg, FL (US) 33710

( * ) Notice: Subject to any disclaimer, the term of this patent is extended or adjusted under 35 U.S.C. 154(b) by 0 days.

(21) Appl. No.: 12/287,133

(22) Filed: Oct. 6, 2008

(51) Int. Cl.
*A61H 3/02* (2006.01)
*A45B 9/04* (2006.01)

(52) U.S. Cl. ..... 135/66; 135/77; 135/84; 623/53

(58) Field of Classification Search ..... 135/65–66, 135/77, 84, 86; 248/188.8–188.9; 36/11.5; 623/53–54
See application file for complete search history.

(56) References Cited

U.S. PATENT DOCUMENTS

| | | | | | |
|---|---|---|---|---|---|
| 4,085,763 | A | | 4/1978 | Thomas | |
| 4,493,334 | A | * | 1/1985 | Semanchik et al. | 135/75 |
| 4,899,771 | A | * | 2/1990 | Wilkinson | 135/77 |
| 4,938,776 | A | * | 7/1990 | Masinter | 623/49 |
| 5,167,746 | A | * | 12/1992 | Sheenan | 156/293 |
| D344,666 | S | * | 3/1994 | Breitrick | D8/89 |
| 5,409,029 | A | * | 4/1995 | Davis | 135/68 |
| 6,003,533 | A | * | 12/1999 | Midcap | 135/84 |
| 6,131,593 | A | * | 10/2000 | Greene et al. | 135/77 |
| 6,217,073 | B1 | * | 4/2001 | Hoffman | 280/823 |
| 6,276,007 | B1 | * | 8/2001 | Brown | 5/81.1 R |
| 6,443,995 | B1 | * | 9/2002 | Townsend et al. | 623/55 |
| 6,527,001 | B1 | | 3/2003 | Swaldan | |
| 6,666,895 | B2 | * | 12/2003 | Johnson et al. | 623/47 |
| 6,793,683 | B1 | * | 9/2004 | Laghi | 623/52 |
| 7,360,547 | B2 | * | 4/2008 | Carlson | 135/66 |
| 2007/0277863 | A1 | * | 12/2007 | Gordon | 135/66 |

FOREIGN PATENT DOCUMENTS

| | | | |
|---|---|---|---|
| EP | 1541053 | A1 * | 6/2005 |
| WO | WO 2007068793 | A1 * | 6/2007 |

* cited by examiner

*Primary Examiner*—Winnie Yip

(57) ABSTRACT

A sole has forward and rearward ends and lateral side edges. The sole has an upper and a lower surface with a periphery. A forward extent and a rearward extent each constitute a minority of the length of the sole. A central extent is provided between the forward and rearward extents. An upwardly extending tube has a free upper end and a lower end coupled to upper surface of the sole. The tube has a threaded aperture. A bolt is threadedly received within the threaded aperture. Strengthening ribs couple to the upper surface of the sole.

1 Claim, 5 Drawing Sheets

BEACH CANE FLIP-FLOP SYSTEM

BACKGROUND OF THE INVENTION

1. Field of the Invention

The present invention relates to a beach cane flip-flop system and more particularly pertains to assisting a cane user while walking on sand through the distribution of force from a small cane tip to an extended area rather than the sinking of the small cane tip into the sand, the assisting being done in a safe, convenient and economical manner.

2. Description of the Prior Art

The use of walking aids of known designs and configurations is known in the prior art. More specifically, walking aids of known designs and configurations previously devised and utilized for the purpose of assisting a user in walking through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,085,763 issued Apr. 25, 1978 to Thomas relates to a Quad Cane and U.S. Pat. No. 6,527,001 issued Mar. 4, 2003 to Swaldan relates to a Stabilizing Cane Attachment.

While these devices fulfill their respective, particular objectives and requirements, the aforementioned patents do not describe a beach cane flip-flop system that allows for assisting a cane user while walking on sand through the distribution of force from a small cane tip to an extended area rather than the sinking of the small cane tip into the sand, the assisting being done in a safe, convenient and economical manner.

In this respect, the beach cane flip-flop system according to the present invention substantially departs from the conventional concepts and designs of the prior art, and in doing so provides an apparatus primarily developed for the purpose of assisting a cane user while walking on sand through the distribution of force from a small cane tip to an extended area rather than the sinking of the small cane tip into the sand, the assisting being done in a safe, convenient and economical manner.

Therefore, it can be appreciated that there exists a continuing need for a new and improved beach cane flip-flop system which can be used for assisting a cane user while walking on sand through the distribution of force from a small cane tip to an extended area rather than the sinking of the small cane tip into the sand, the assisting being done in a safe, convenient and economical manner. In this regard, the present invention substantially fulfills this need.

SUMMARY OF THE INVENTION

In view of the foregoing disadvantages inherent in the known types of walking aids of known designs and configurations now present in the prior art, the present invention provides an improved beach cane flip-flop system. As such, the general purpose of the present invention, which will be described subsequently in greater detail, is to provide a new and improved beach cane flip-flop system and method which has all the advantages of the prior art and none of the disadvantages.

To attain this, the present invention essentially comprises a beach cane flip-flop system. First provided is a pair of similarly configured soles. Each sole has a forward end. Each sole has a rearward end. Each sole has lateral side edges. The side edges are provided between the forward and rearward ends.

Each sole has an upper surface. Each sole has a lower surface. Each sole has a periphery. The periphery is provided between the upper and lower surfaces. Each sole has a forward extent. The forward extent constitutes about 5 percent of the length of each sole. Each sole has a rearward extent. The rearward extent constitutes about 5 percent of the length of each sole. Each sole is curved about a short first axis of rotation above the sole and between the forward and rearward end. Each sole has a central extent. The central extent is provided between the forward and rearward extents. The central extent is curved about a long second axis of rotation greater than the first axis of rotation. The soles are mirror images of each other. The soles are provided in an hour glass configuration. The soles are narrower in the central extent. The soles are wider in the forward and rearward extents.

An upwardly extending tube is provided. The tube has a lower end. The lower end is coupled to upper surface of each sole. The tube has a free upper end. Each tube has a vertical axis. The axis is essentially equally spaced between the forward and rearward end. The vertical axis is essentially equally spaced between the laterally spaced sides edges. The interior diameter of each tube is between 40 percent and 60 percent of the width of the sole at its narrowest extent. The diameter of each tube is between 30 percent and 50 percent of the width of the sole at its widest extent. The diameter of the tube is between 8 percent and 12 percent of the length of the sole. The axial length of each tube is essentially equal to the exterior diameter of the tube. Each tube has a threaded aperture. The aperture faces the rearward end. A bolt is provided. The bolt is threadedly received within the threaded aperture.

Provided next are strengthening ribs. The ribs are coupled to the upper surface of each sole. The ribs include a forward central rib. The forward central rib is provided between the tube and the forward end. The ribs include a rearward central rib. The rearward central rib is provided between the tube and the rearward end. The ribs include a V-shaped rib. An apex is provided. The apex is provided between the tube and the forward end. The ribs have free ends. The free ends are provided at the lateral side edges between the tube and the rearward end. Each rib has a curved lower edge. The curved lower edge has axis of rotation. The axis of rotation is provided above the sole. Each rib has a curved upper edge. The curved upper edge has an axis of rotation. The axis of rotation is provided below the sole.

Provided next are position indicia. The indicia include five toe indicators. The five toe indicators are formed on the upper surface of each sole in the forward extent. The indicia include two toe indicators. The two toe indicators are provided on a first side of the forward rib. The indicia include three toe indicators. The three toe indicators are provided on a second side of the forward ribs.

Provided last is a plurality of treads. The treads are coupled to the lower surface of each sole. Each tread has an upper surface. Each tread is in a curved configuration. Each tread conforms to the lower surface of the sole. Each tread has a lower surface. The lower surface is provided in a common horizontal plane. Each tread is in a V-shaped configuration. Each tread has an apex. The apex faces forwardly. Each tread has free ends. The free ends are provided adjacent to the lateral side edges. The soles and ribs and treads are fabricated of polycarbonate. The polycarbonate is flexible and resilient.

Provided last is a cane. The cane has a lower end. The lower end is positioned in the tube. The bolt is threaded into contact with the lower end of the cane. In this manner securement is provided.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beach cane flip-flop system which has all of the advantages of the prior art walking aids of known designs and configurations and none of the disadvantages.

It is another object of the present invention to provide a new and improved beach cane flip-flop system which may be easily and efficiently manufactured and marketed.

It is further object of the present invention to provide a new and improved beach cane flip-flop system which is of durable and reliable constructions.

An even further object of the present invention is to provide a new and improved beach cane flip-flop system which is susceptible of a low cost of manufacture with regard to both materials and labor, and which accordingly is then susceptible of low prices of sale to the consuming public, thereby making such beach cane flip-flop system economically available to the buying public.

Even still another object of the present invention is to provide a beach cane flip-flop system for assisting a cane user while walking on sand through the distribution of force from a small cane tip to an extended area rather than the sinking of the small cane tip into the sand, the assisting being done in a safe, convenient and economical manner.

Lastly, it is an object of the present invention to provide a new and improved beach cane flip-flop system. A sole has forward and rearward ends and lateral side edges. The sole has an upper and a lower surface with a periphery. A forward extent and a rearward extent each constitute a minority of the length of the sole. A central extent is provided between the forward and rearward extents. An upwardly extending tube has a free upper end and a lower end coupled to upper surface of the sole. The tube has a threaded aperture. A bolt is threadedly received within the threaded aperture. Strengthening ribs couple to the upper surface of the sole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
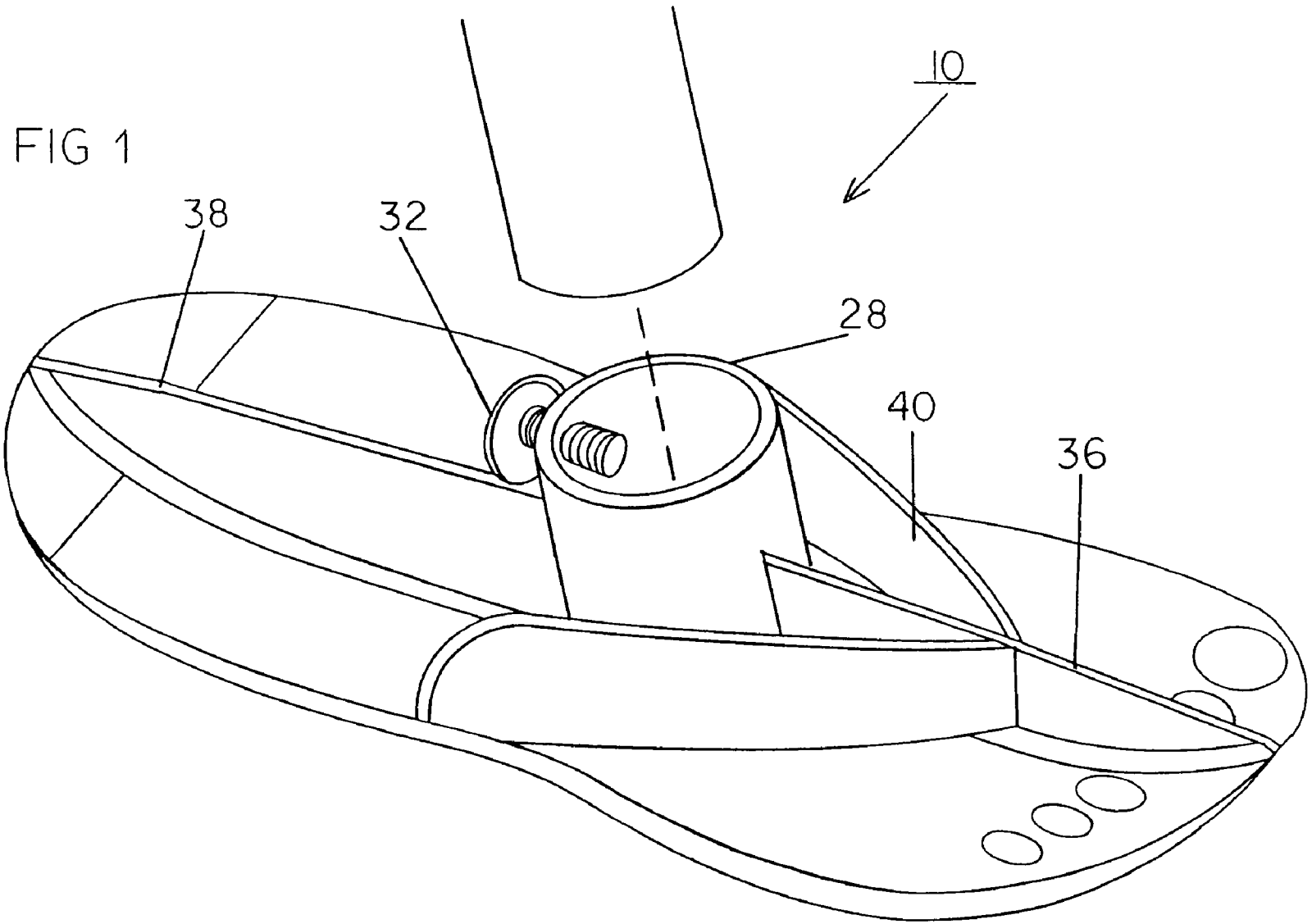
FIG. 1 is a perspective illustration of a beach cane flip flop system constructed in accordance with the principles of the present invention.
Figure 2:
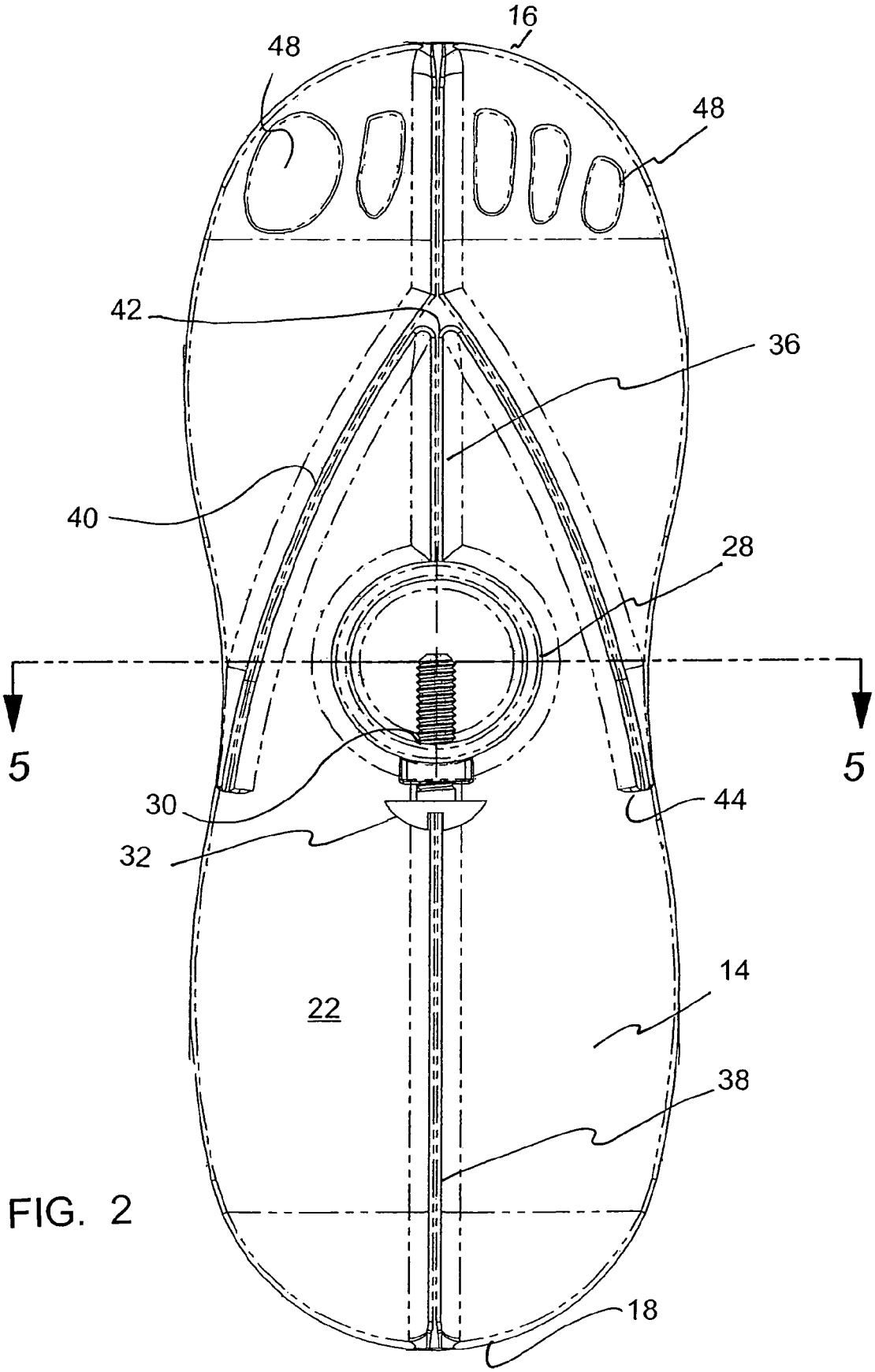
FIGS. 2, 3 and 4 are plan, bottom and side elevational views of the system illustrated in FIG. 1.
Figure 3:
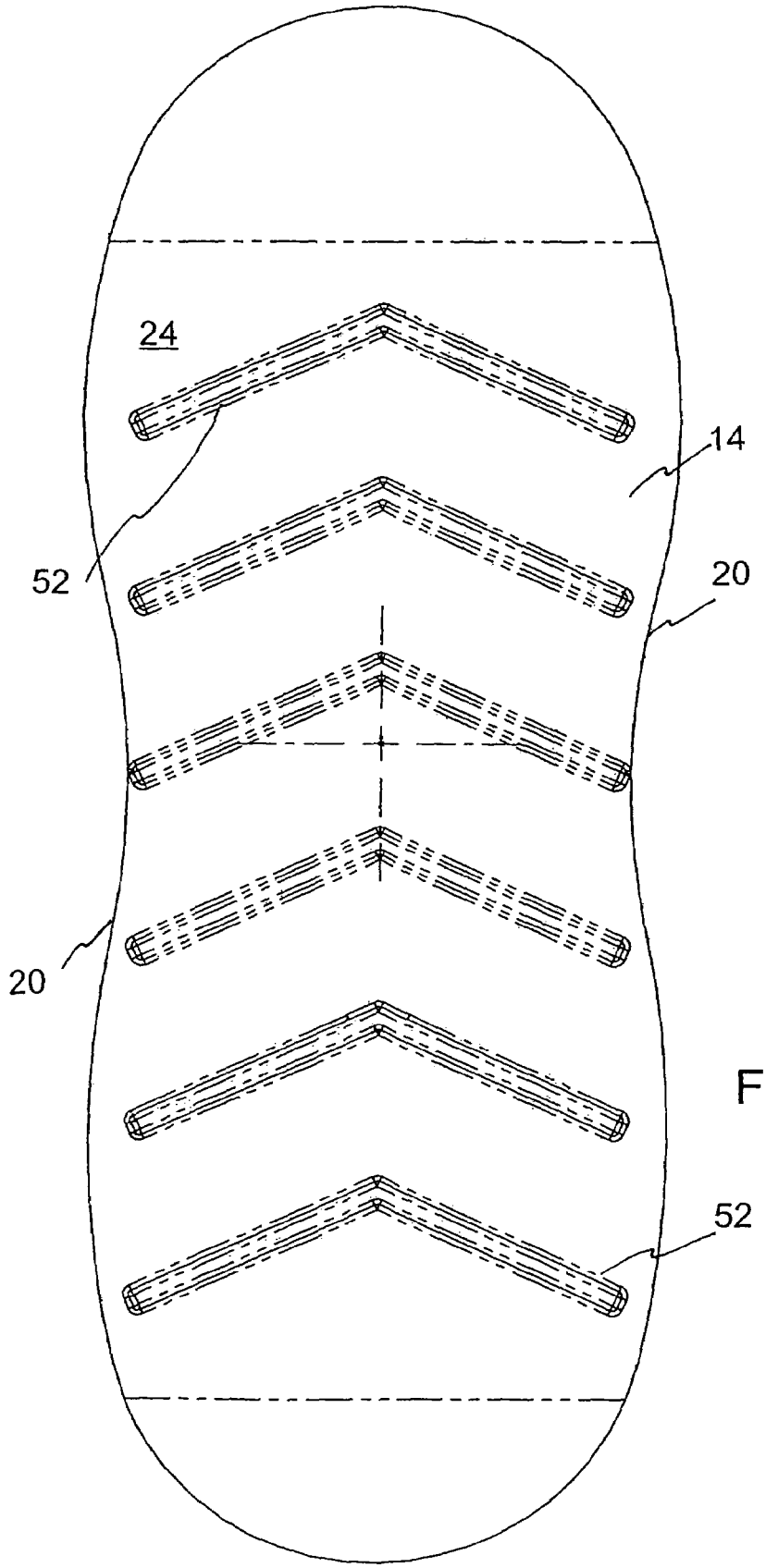
Figure 4:
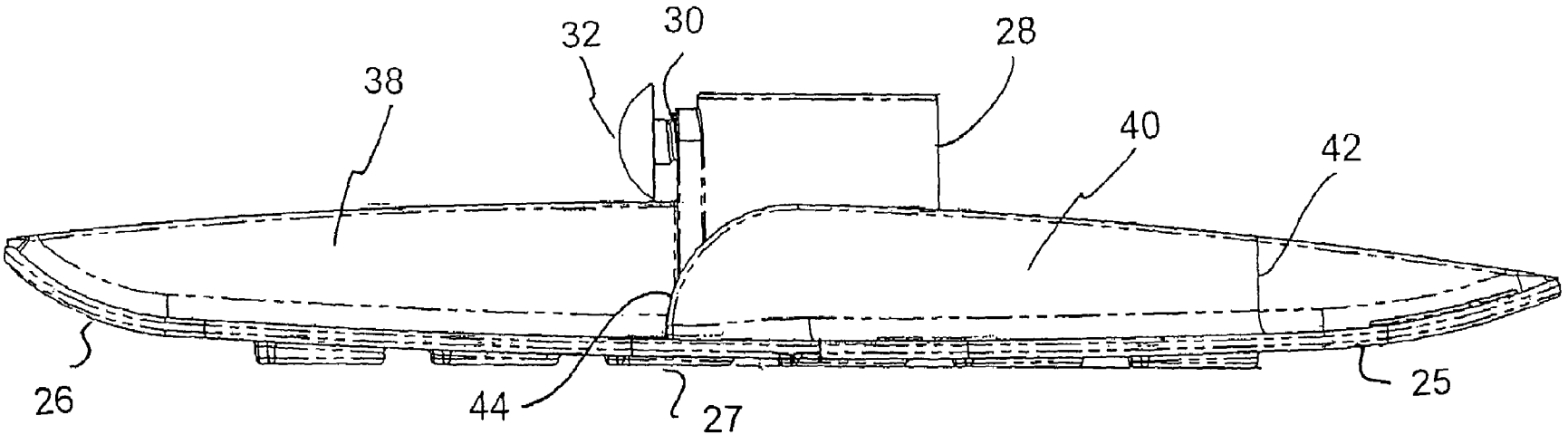
Figure 5:
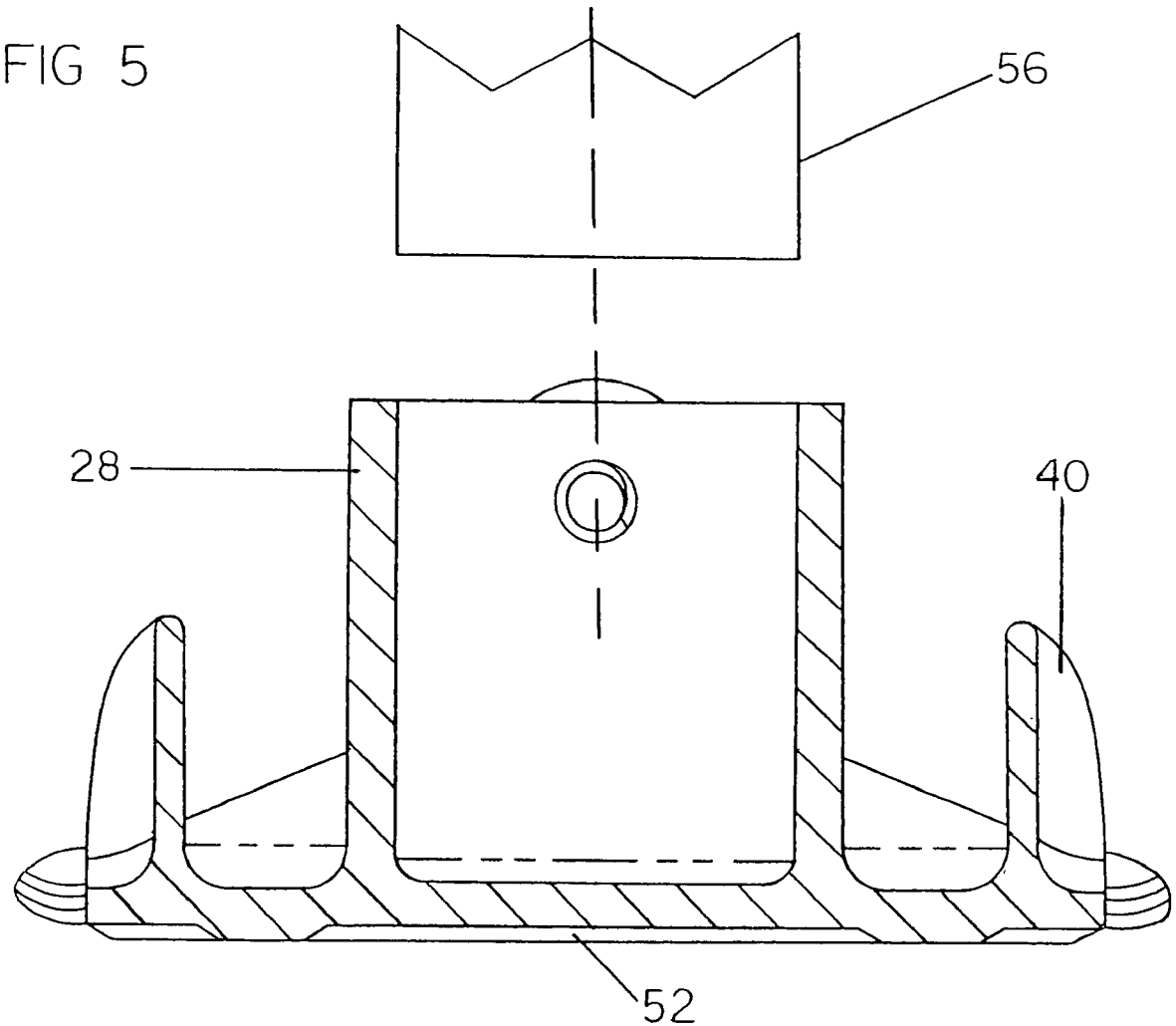
FIG. 5 is a cross sectional views of the system taken along line 5-5 of FIG. 2.

With reference now to the drawings, and in particular to FIG. 1 thereof, the preferred embodiment of the new and improved beach cane flip-flop system embodying the principles and concepts of the present invention and generally designated by the reference numeral 10 will be described.

The present invention, the beach cane flip-flop system 10 is comprised of a plurality of components. Such components in their broadest context include a sole, an upwardly extending tube and strengthening ribs. Such components are individually configured and correlated with respect to each other so as to attain the desired objective.

First provided is a sole 14. The sole has a forward end 16. The sole has a rearward end 18. The sole has lateral side edges 20. The side edges are provided between the forward and rearward ends. The sole has an upper surface 22. The sole has a lower surface. The sole has a periphery 24. The periphery is provided between the upper and lower surfaces. The sole has a forward extent 25. The forward extent constitutes about 5 percent of the length of the sole. The sole has a rearward extent 26. The rearward extent constitutes about 5 percent of the length of each sole. The sole is curved about a short first axis of rotation above the sole and between the forward and rearward end. The sole has a central extent 27. The central extent is provided between the forward and rearward extents. The central extent is curved about a long second axis of rotation greater than the first axis of rotation. The sole is provided in an hour glass configuration. The sole is narrower in the central extent. The sole is wider in the forward and rearward extents. It should be understood that illustrated is a sole for use on a cane on the right side of a user and that an embodiment for use on a cane for use on the left side would be a mirror image.

An upwardly extending tube 28 is provided. The tube has a lower end. The lower end is coupled to upper surface of each sole. The tube has a free upper end. Each tube has a vertical axis. The axis is essentially equally spaced between the forward and rearward end. The vertical axis is essentially equally spaced between the laterally spaced sides edges. The interior diameter of each tube is between 40 percent and 60 percent of the width of the sole at its narrowest extent. The diameter of each tube is between 30 percent and 50 percent of the width of the sole at its widest extent. The diameter of the tube is between 8 percent and 12 percent of the length of the sole. The axial length of each tube is essentially equal to the exterior diameter of the tube. Each tube has a threaded aperture 30. The aperture faces the rearward end. A bolt 32 is provided. The bolt is threadedly received within the threaded aperture.

Provided next are strengthening ribs. The ribs are coupled to the upper surface of each sole. The ribs include a forward central rib 36. The forward central rib is provided between the tube and the forward end. The ribs include a rearward central rib 38. The rearward central rib is provided between the tube and the rearward end. The ribs include a V-shaped rib 40. An apex 42 is provided. The apex is provided between the tube and the forward end. The ribs have free ends 44. The free ends are provided at the lateral side edges between the tube and the rearward end. Each rib has a curved lower edge. The curved lower edge has axis of rotation. The axis of rotation is provided above the sole. Each rib has a curved upper edge. The curved upper edge has an axis of rotation. The axis of rotation is provided below the sole.

Provided next are position indicia. The indicia include five toe indicators 48. The five toe indicators are formed on the upper surface of each sole in the forward extent. The indicia include two toe indicators. The two toe indicators are provided on a first side of the forward rib. The indicia include three toe indicators. The three toe indicators are provided on a second side of the forward ribs.

Provided last is a plurality of treads 52. The treads are coupled to the lower surface of each sole. Each tread has an upper surface. Each tread is in a curved configuration. Each tread conforms to the lower surface of the sole. Each tread has a lower surface. The lower surface is provided in a common horizontal plane. Each tread is in a V-shaped configuration. Each tread has an apex. The apex faces forwardly. Each tread has free ends. The free ends are provided adjacent to the lateral side edges. The soles and ribs and treads are fabricated of polycarbonate. The polycarbonate is flexible and resilient.

Provided last is a cane 56. The cane has a lower end. The lower end is positioned in the tube. The bolt is threaded into contact with the lower end of the cane. In this manner securement is provided.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beach cane flip-flop system for assisting a cane user while walking on sand through the distribution of force from a small cane tip to an extended area rather than the sinking of the small cane tip into the sand, the assisting being done in a safe, convenient and economical manner, the system comprising, in combination:

a sole having a forward end and a rearward end with lateral side edges there between, the sole having an upper surface and a lower surface with a periphery there between, a forward extent constituting about 5 percent and a rearward extent constituting about 5 percent of a length of the sole, the sole being curved about a short first axis of rotation above the sole and between the forward and rearward end, a central extent of each sole between the forward and rearward extents being curved about a long second axis of rotation greater than the first axis of rotation, the sole being in an hour glass configuration having a width being narrower in the central extent and wider in the forward and rearward extents;

an upwardly extending tube having a free upper end and a lower end coupled to the upper surface of the sole, the tube having a vertical axis essentially equally spaced between the forward and rearward end, the vertical axis essentially equally spaced between the laterally spaced sides edges, an interior diameter of the tube being between 40 percent and 60 percent of the width of the sole at its narrowest extent and between 30 percent and 50 percent of the width of the sole at its widest extent, and between 8 percent and 12 percent of the length of the sole, an axial length of the tube being essentially equal to an exterior diameter of the tube, the tube having a threaded aperture there through facing the rearward end with a bolt threadedly received within the threaded aperture;

strengthening ribs coupled to the upper surface of the sole, the ribs including a forward central rib extending between the tube and the forward end, the ribs including a rearward central rib extending between the tube and the rearward end, the ribs including a V-shaped rib with an apex formed between the tube and the forward end and with free ends at the lateral side edges between the tube and the rearward end, each rib having a curved lower edge with an axis of rotation above the sole, each rib having a curved upper edge with an axis of rotation below the sole;

a position indicia including five toe indicators formed on the upper surface of each sole in the forward extent, two of the toe indicators located on a first side of the forward rib and three of the toe indicators located on a second side of the forward rib;

a plurality of treads coupled to the lower surface of the sole, each tread having an upper surface in a curved configuration conforming to the lower surface of the sole, each tread having a lower surface in a common horizontal plane, each tread being in a V-shaped configuration with an apex facing forwardly and free ends adjacent to the lateral side edges, the sole and ribs and treads being fabricated of polycarbonate with flexibility and resilience; and a cane with a lower end positioned in the tube with the bolt threaded into contact with the lower end of the cane for securement purposes.

* * * * *